US005836791A

United States Patent [19]

Waas et al.

[11] Patent Number: 5,836,791

[45] Date of Patent: Nov. 17, 1998

[54] MODULAR TELECOMMUNICATIONS TERMINAL BLOCK

[75] Inventors: Charles W. Waas, Huntington Beach; Mark R. Jespersen, Burbank, both of Calif.

[73] Assignee: PSI Telecommunications, Inc., Burbank, Calif.

[21] Appl. No.: 817,750

[22] PCT Filed: Oct. 24, 1994

[86] PCT No.: PCT/US94/11908

§ 371 Date: Apr. 18, 1997

§ 102(e) Date: Apr. 18, 1997

[87] PCT Pub. No.: WO96/13077

PCT Pub. Date: May 2, 1996

[51] Int. Cl.[6] ..... H01R 9/22

[52] U.S. Cl. ..... 439/709; 439/922

[58] Field of Search ..... 439/709, 715, 439/716, 412, 411, 413, 417

[56] References Cited

U.S. PATENT DOCUMENTS

| | | |
|---|---|---|
| D. 306,716 | 3/1990 | Shimirak . |
| 4,223,971 | 9/1980 | Dola et al. . |
| 4,339,167 | 7/1982 | Liedholm . |
| 4,462,655 | 7/1984 | Campbell et al. . |
| 4,631,453 | 12/1986 | DeSouza et al. . |
| 4,639,068 | 1/1987 | McMills et al. . |
| 4,733,325 | 3/1988 | Loesch . |
| 4,736,269 | 4/1988 | Amein et al. . |
| 4,796,150 | 1/1989 | Dickey et al. . |
| 4,821,147 | 4/1989 | Jacobs et al. . |
| 4,846,721 | 7/1989 | Debruycker et al. . |
| 4,866,563 | 9/1989 | Howard et al. . |
| 4,901,189 | 2/1990 | Merriman et al. . |
| 4,911,655 | 3/1990 | Pinyan et al. . |
| 5,069,636 | 12/1991 | Shimirak et al. . |
| 5,069,637 | 12/1991 | Baubles . |
| 5,112,245 | 5/1992 | Shimirak . |
| 5,149,278 | 9/1992 | Waas et al. . |
| 5,166,855 | 11/1992 | Turner . |
| 5,167,526 | 12/1992 | Pinyan et al. . |
| 5,173,060 | 12/1992 | Shimirak et al. . |
| 5,273,449 | 12/1993 | Mattis et al. . |
| 5,324,212 | 6/1994 | Fremgen . |
| 5,357,057 | 10/1994 | Debbaut . |
| 5,359,654 | 10/1994 | Jensen et al. . |
| 5,435,747 | 7/1995 | Franckx et al. . |

FOREIGN PATENT DOCUMENTS

| | | |
|---|---|---|
| 2 516 711 | 5/1983 | France . |
| 44 37022 | 2/1996 | Germany . |
| 2 129 630 | 5/1984 | United Kingdom . |
| WO 92/15129 | 9/1992 | WIPO . |
| WO 94/13032 | 6/1994 | WIPO . |
| WO 94/18722 | 8/1994 | WIPO . |

OTHER PUBLICATIONS

"Terminal Systems for the 90's . . . and Beyond", by PSI Telecom, May 1994.

*Primary Examiner*—Neil Abrams
*Assistant Examiner*—Daniel Wittels
*Attorney, Agent, or Firm*—Graham & James LLP

[57] ABSTRACT

A modular telecommunications terminal block system includes one or more terminal blocks (10) which may be repeatedly installed and removed from a mounting rail (24). Each terminal block (10) employs a housing (12) having a telephone exchange wire carrier and a service wire carrier within the housing. An exchange to be connected to the terminal block (10) is inserted through an opening (36) in the housing and into the exchange wire carrier (20) which is movable between an open position and a closed position. By manually pressing the exchange wire (20) in the closed position, or by installating the terminal block (10) onto the mounting rail (24), the exchange wire is terminated to an exchange wire contact element (170) within the terminal block (10). A service wire is separately terminated within the terminal block and engages a service wire contact element (66, 68). Insertion of a linking module (16) into an access jack (120) provides connection between the exchange wire contact element (170) and the service wire contact element (66, 68).

14 Claims, 13 Drawing Sheets

MODULAR TELECOMMUNICATIONS TERMINAL BLOCK

This application is filed under 35 USC 371 of PCT/US94/11908 which was filed on Oct. 21, 1994.

BACKGROUND OF THE INVENTION

1. Field of the Invention

The present invention relates to terminal blocks for connecting wire pairs. More particularly, the present invention relates to telecommunications terminal blocks for connecting telephone service wires to telephone exchange distribution cables.

2. Background of the Prior Art and Related Information

Telecommunications terminal blocks are used to provide convenient electrical connections between telephone customer service wires (the "service" side) and telephone exchange distribution cables (the "exchange" side). Such terminal blocks typically connect up to 25 distribution cable wire pairs on the exchange side, which may have several thousand wire pairs, to up to 25 individual service wire pairs on the service side.

Terminal blocks generally are configured as standard, multi-chambered units which terminate either 5, 10 or 25 wire pairs. In many cases the number of distribution wire pairs to be terminated may not conform to the standard number. For example, if 7 wire pairs need to be terminated, a terminal block for 10 wire pairs, the closest standard terminal block size, must be installed even through 3 of the 10 wire pair terminations will not be used.

The exchange side wire pairs are difficult to replace in that a splicing cable which provides the connection from the distribution cable to the exchange side of the terminal block is typically permanently joined to the terminal block during connection of the splice cable to the terminal block. The permanent connection protects both the splicing cable and the exchange side of the terminal block from the environment and ensures a physically secure connection designed to withstand the recurring installing and removing of connections on the service side.

When a connection on the exchange side of the terminal block fails, the entire terminal block of 5, 10 or 25 wire pairs must be replaced, requiring a new terminal block and significant installation time and resources. The connection between the splice cable and the failed terminal block must be physically cut and the old terminal block discarded, even if only a single connection has failed on the exchange side. In addition, in replacing the terminal block, all existing service side connections must be disconnected. A new terminal block may then be permanently installed on the splice cable and all the service side connections connected. This approach uses significant resources and results in many terminal blocks being discarded for only a single failure.

The service side of terminal blocks is generally subject to the most use because the service side is used to repeatedly connect or disconnect telephone service to the distribution cable through the terminal block. Service wire pairs are typically connected to the terminal block through some type of terminal which is easy to connect and disconnect on site such as a simple binding post where a stripped service wire is connected to the binding post and then secured with some type of cap. Another common type of terminal is an insulation displacement terminal where the service wire need not be bared prior to the connection to the terminal block and the insulation is severed through a blade or other sharp surface as the service wire is secured to the terminal. Again, in the insulation displacement type of terminal, some type of cap is typically employed to secure the service wire in place.

While the caps typically employed in the binding post or insulation displacement type terminals provide some protection from the environment, nonetheless, moisture, pollutants, chemicals, dust and even insects may reach the terminal connection resulting in corrosion or other degradation of the contact. This problem is exacerbated by the fact that in addition to the traditional aerial location of such terminal blocks, underground and even underwater terminal block locations are more and more frequently required for telephone distribution applications. Accordingly, efforts have been made to better insulate the terminal in the terminal block from the environment to prevent such degradation. One such approach has been to use a variety of insulating mediums, such as greases or gels to surround the terminal where the electrical connection is made.

In order to properly test connections and determine if a problem is related to the exchange side or the service side is it necessary to disconnect one side so that either side may be evaluated independently. Generally, the service side is disconnected because it may not be possible to disconnect the exchange side wires. In this case, additional time is spent disconnecting the service side wires, stripping the wires, and connecting the wires to test equipment to assess the problem. Once the problem is solved, the test assembly must be removed and the service side wires connected to the terminal block. This process requires significant time.

Accordingly, a need presently exists for an improved telecommunications terminal block for connecting wires from the exchange side to the service side such that individual terminal blocks may be added or removed as required while maintaining resistance to moisture and other environmental factors which subject the connections therein to degradation over time and limit the applications where such terminal blocks may be reliably employed. In addition, a need presently exists for an improved telecommunications terminal block for which permits testing of the service or exchange sides without disconnecting service or exchange side wires.

SUMMARY OF THE INVENTION

The present invention provides a modular telecommunications terminal block system including a variable number of individual terminal blocks for connecting service wires to a telephone exchange cable such that individual terminal blocks may be added or removed as required while maintaining an insulating medium within each terminal block. This medium, which may be a grease or gel, provides resistance to moisture and other environmental factors which subject the connections therein to degradation over time.

In a preferred embodiment, each of the individual terminal blocks of the modular telecommunications terminal block of the present invention employs a separate housing formed of a dielectric material. Each individual terminal block is attached to a mounting rail and held in place, for example, by a pliable clip integrally formed with the housing. Each housing forms a separate receptacle for the insulating medium which flows within chambers in the housing during wire connection and disconnection.

Connection to the exchange cable wires is provided via an exchange wire carrier movable relative to the housing and configured on an exchange side of the housing. Connection to service wires in turn is provided by a service wire carrier movably configured in a chamber within the housing, accessible from an opposite service side of the housing.

More specifically, a pair of exchange wire access slots are provided on the housing to receive a pair of exchange wires. Within a chamber in the housing, proximate the exchange wire access slots, is located the exchange wire carrier. The exchange wire carrier is movable between an open position and a closed position and receives each of the exchange wires into respective exchange wire conduits. The exchange wire carrier is held in place in the selected position by a retaining stub which slides into either of two retaining stub slots in the housing which correspond to the chosen position, open or closed, of the exchange wire carrier.

When the exchange wire carrier is in the open position, the exchange wire conduits may receive each exchange wire through the exchange wire access slots in the housing. The exchange wire carrier has two slots for receiving insulation piercing electrical contact blades. The insulation piercing contact blades are integrally formed with an exchange wire junction contact which is retained in a slot in the access jack.

The terminal block may be easily mounted on the mounting rail by hooking a lip configured proximate the service end of the terminal block over an edge of the mounting rail. The exchange end of the terminal block is then pushed into place over the other edge of the mounting rail until a pliable clip integral to the housing snaps into place. Therefore each end of the terminal block is secured to the mounting rail.

As the exchange side is pushed onto the mounting rail, the exchange wire carrier is forced upward by the pressure from the mounting rail and is moved into the closed position. When the exchange wire carrier is moved to the closed position, the insulation piercing contact blades pierce the insulation of the exchange wires and come into contact with the conductive portion of the exchange wires. As a result, the exchange wires are in conductive contact with the exchange wire junction contact in a slot in the access jack.

Once installed on the mounting rail, service wires may be terminated at the service side of the terminal block. Upon termination, each service wire is in conductive communication with a service wire junction contact retained within a slot in the access jack. A linking module is inserted into the access jack which has two sets of contacts which form a conductive path between each service wire and corresponding exchange wire. Each set of contacts may be accessed through "tee-in" ports on the top of the linking module.

The linking module may include many types of plug-in units including a bridge module which simply connects the service side to the exchange side. Another embodiment includes a protector module which connects the service and exchange sides when plugged into the access jack and includes a twin gas discharge tube and an earth junction contact. Each end of the twin gas discharge tube is soldered to one set of contacts and the earth junction contact is conductively connected to the center of the gas discharge tube.

The another embodiment of the linking module is the two-way testing module. The two way testing module includes a set of service wire testing contacts and a set of exchange wire testing contacts. The cover of the two way testing module includes a bayonet contact. The service wire and exchange wire testing contacts are each formed with a slot which retains the bayonet contact and which connects the service side to the exchange side when the bayonet contact is inserted. The bayonet contact is automatically inserted into the testing contacts when the cover of the two-way testing module is closed. Therefore, when the cover is closed the exchange side is connected to the service side. The two-way testing module is sealed with a gasket when the lid is closed. The gasket provides the internal components of the gasket with protection from the environment.

When the cover is open the exchange side is no longer connected to the service side and the ends of the service wire testing contacts and the exchange wire testing contacts are exposed above the gasket so that an alligator-type or equivalent test connector can be conveniently connected to either the service wire test contacts or the exchange wire test contacts for testing.

Another embodiment of the two-way testing module includes a protected two-way testing module which connects the service and exchange sides when plugged into the access jack and includes a twin gas discharge tube and an earth junction contact. Each end of the twin gas discharge tube is soldered to one set of contacts and the earth junction contact is conductively connected to the center of the gas discharge tube.

When either the protector module or the protected two-way testing module is to be used, the earth junction contact needs to be at earth potential. To achieve this, the mounting rail is connected to earth during installation. The mounting rail thus provides the necessary earth connection point for each terminal block. When the terminal block is installed on the mounting rail a terminal block earth connector retained within the exchange wire carrier is connected to the mounting rail earth connector. The terminal block earth connector is conductively connected to an earth junction contact retained in the central slot of the access jack. Therefore, when the protector module is plugged into the access jack, the earth junction contact enters the center slot of the access jack and connects the protector module to earth through the mounting rail. Among its many functions, the gas discharge tube and earth junction contact connection perform in conjunction with the two sets of contacts to shunt voltage to earth in the event there are voltage spikes on the conductive path between the service side and the exchange side, for example.

Room is provided in the exchange wire carrier, the chamber containing the service wire carrier and the linking module for the insulating medium, such as a grease or gel, to be injected so as to surround each wire carrier and set of contacts and fill the wire engaging openings in the carriers. The medium flows around the respective carriers during wire termination without forcing medium out of the housing.

The service wires may be removed and reconnected through the service side openings and the service wire carrier numerous times.

The terminal block may be installed and removed from the mounting rail as many times as needed while retaining the insulating medium therein. Removal from the mounting rail is accomplished by lifting the clip and releasing the terminal block from the mounting rail. No specialized tools are required. Once removed, the exchange wire carrier may be moved back into the open position in order to remove the exchange wires. Upon removal, the terminal block may be reused.

A reliable, easy to manufacture structure is a further feature of the terminal block of the present invention. Further features and advantages of the present invention will be appreciated by review of the following detailed description of the present invention.

Accordingly, it will be appreciated that the present invention provides an improved telecommunications terminal block having significantly improved resistance to environmental factors such as moisture, chemicals and other such contaminants while retaining a relatively simple construction.

DETAILED DESCRIPTION OF THE INVENTION

Figure 1:
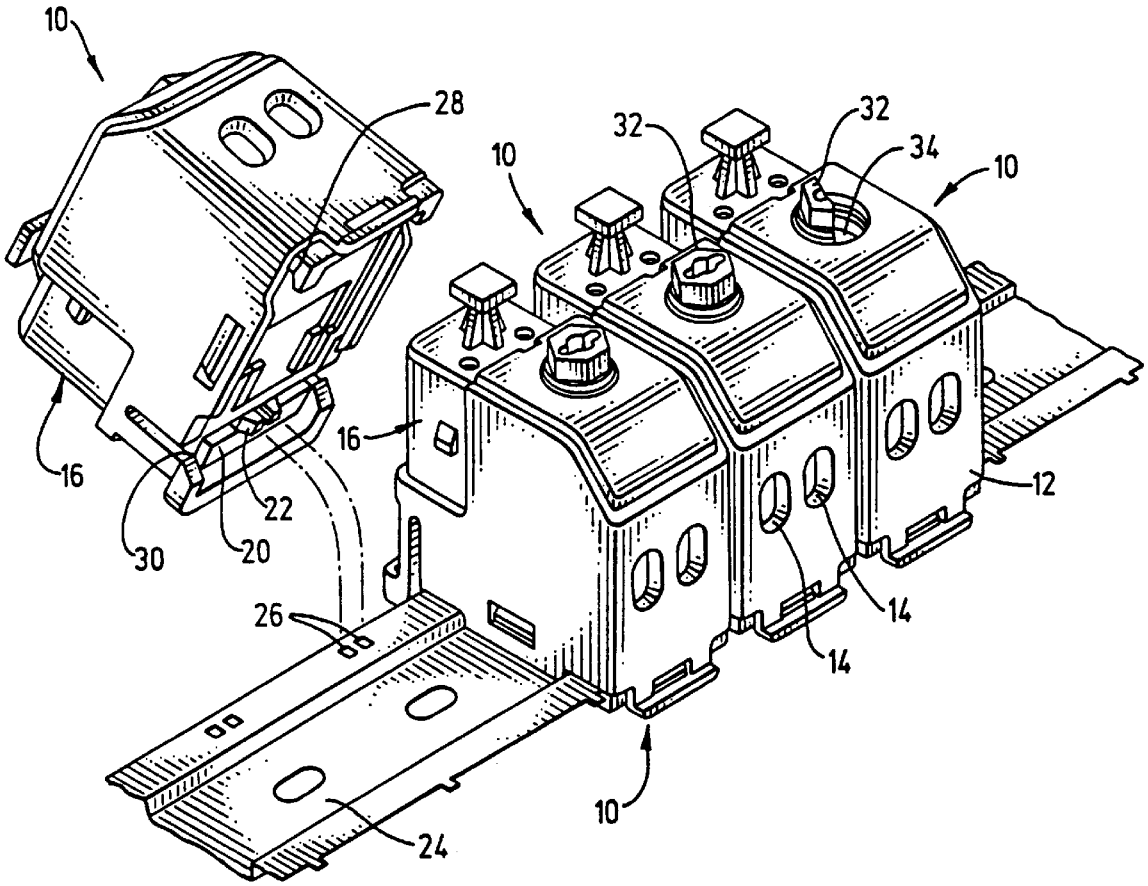
FIG. 1 is a perspective view of a service side of a preferred embodiment of the modular terminal block system of the present invention.

Referring to FIG. 1, the modular terminal block system of the present invention is illustrated. As shown, in a preferred embodiment of the present invention a number of individual terminal blocks is employed, which number may vary from 1 to 25 or more with the specific application. One of the terminal blocks is shown as removed from the mounting rail.

Each terminal block 10 of the modular system of the present invention employs a separate terminal block housing 12. The service side of the terminal block is illustrated and has service wire pair openings 14 along a front surface thereof. As will be discussed in more detail below, the wire pair openings 14 provide service wires access into an internal chamber within the housing 12. Housing 12 is composed of a dielectric material, suitable for manufacture in the desired shape. For example, any one of several commercially available thermoplastic resins may be readily employed due to their relatively low cost and ease of manufacture. Other dielectric materials may be also employed, however.

Figure 3:
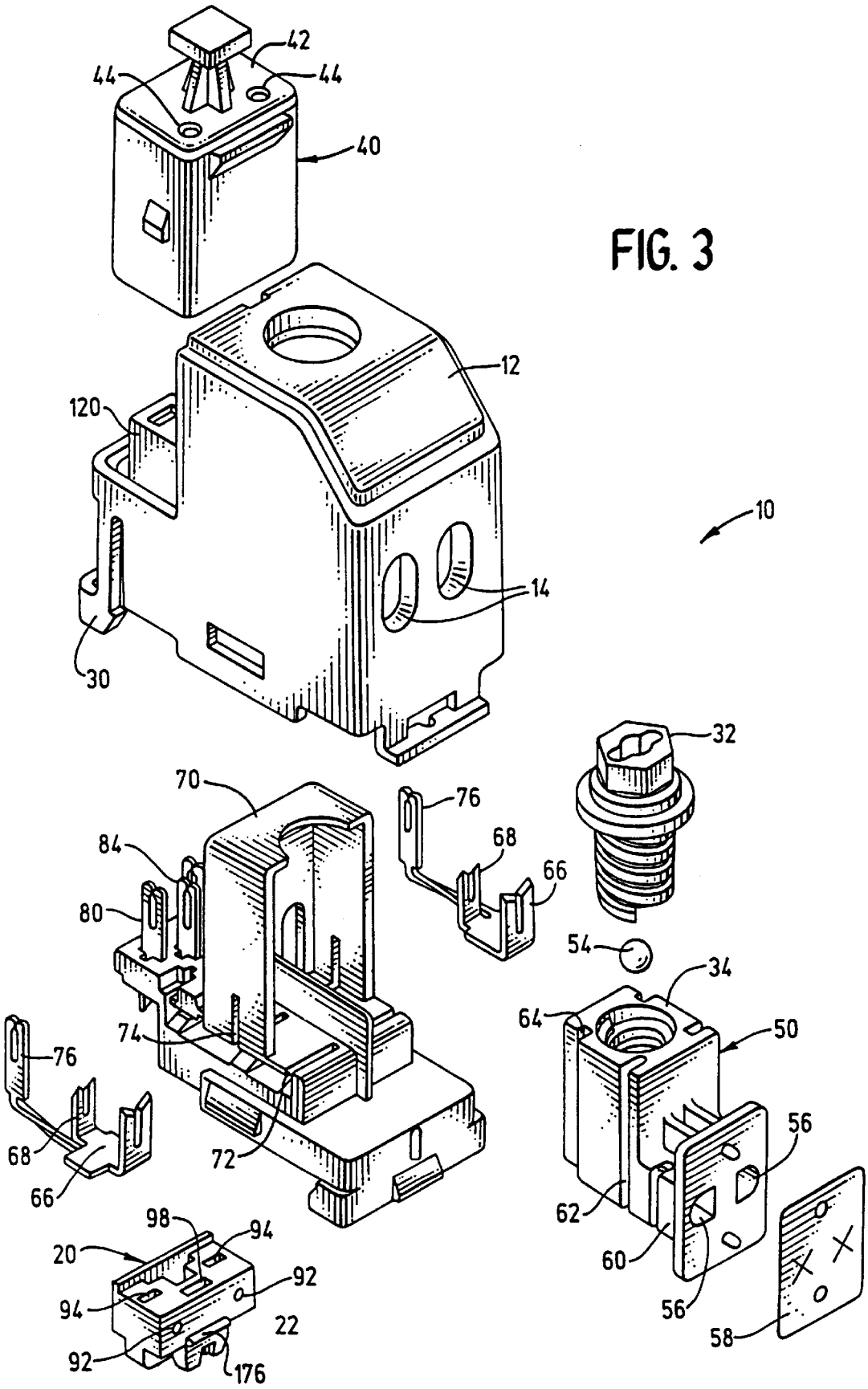
FIG. 3 is an exploded view of the basic components of the terminal block housing including a service side wire carrier and an exchange side wire carrier of the present invention.
Figure 4:
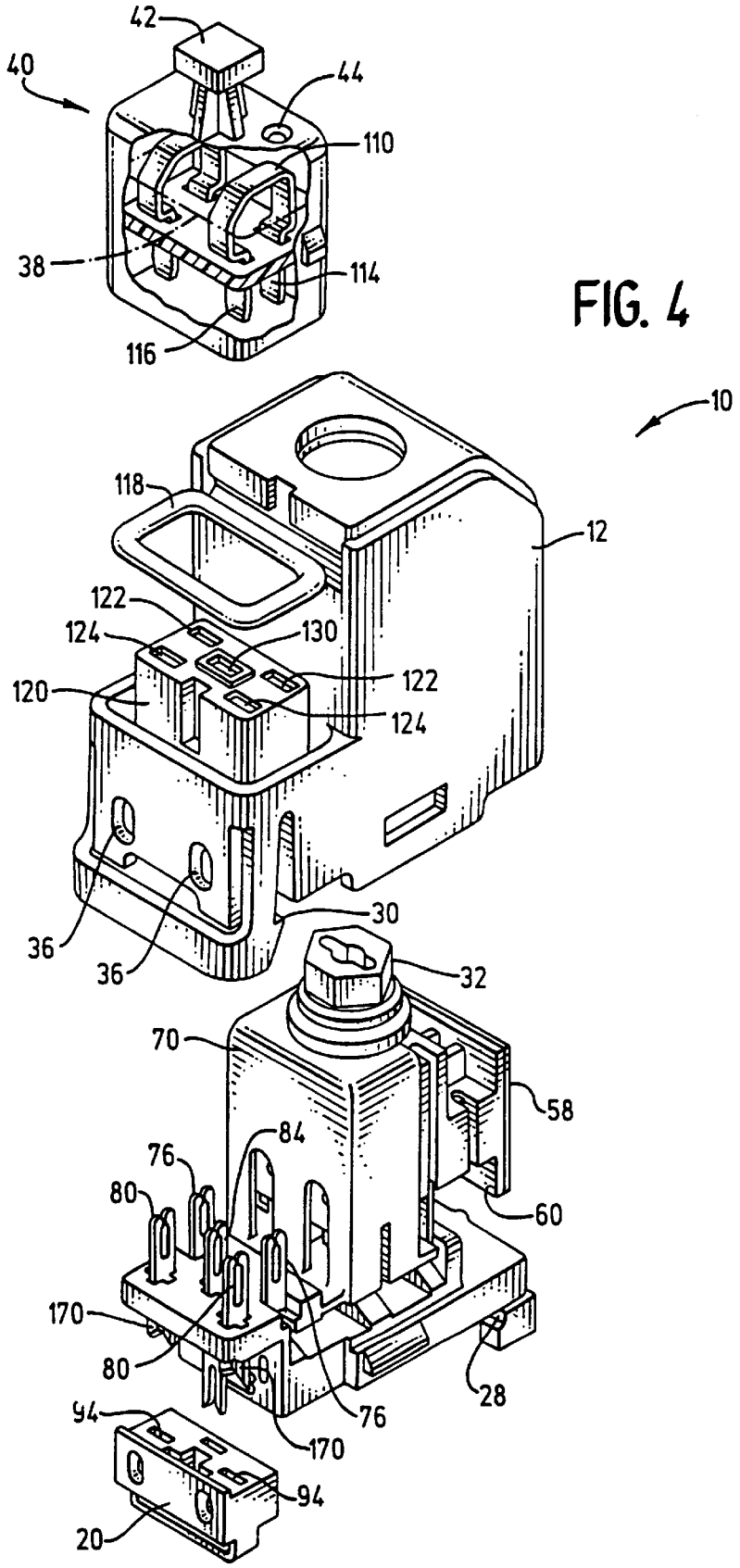
FIG. 4 is an exploded view illustrating the housing and the housing insert of a terminal block in accordance with the present invention.

As illustrated in FIGS. 1, 3 and 4, a portion of the bottom of the terminal block 10 of the present invention includes an exchange wire carrier 20. The exchange wire carrier 20 is preferably made of a dielectric material which may be the same as housing 12. The exchange wire carrier also includes an earth connector guide 22 which protrudes down from the base of the exchange wire carrier 20.

Figure 9:
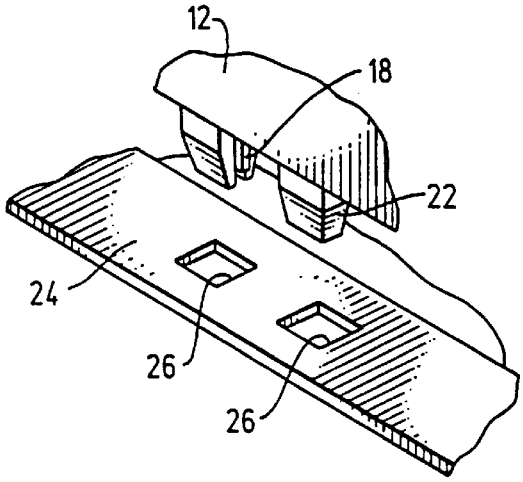
FIG. 9 shows a perspective view of the detail of an earth connection between a terminal block and the mounting rail in accordance with the present invention.
Figure 10:
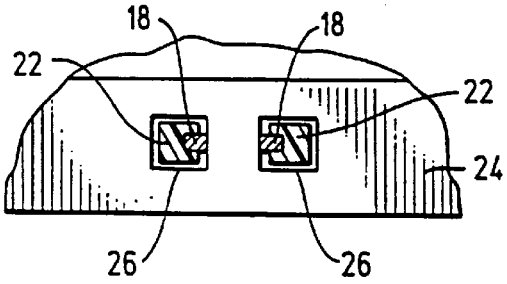
FIG. 10 shows a bottom view of the detail of the earth connection between the terminal block and the mounting rail.

The earth connector guide 22, best shown in FIGS. 3, 4 and 10, supports an earth connector 18 which connects to the mounting rail 24 in a manner as illustrated in FIGS. 9 and 10. The terminal block is mounted on a standard DIN mounting rail 24 modified to include the rail earth connector 26 which is tied to "earth" by connecting the conducting mounting rail 24 to earth upon installation. The mounting rail 24 may be manufactured from steel or aluminum or any other suitably conductive material. Earth connector 18, supported by the earth connector guide 22, provides the conductive connection to the rail earth connector 26. FIG. 9 illustrates a perspective view of the detail of the earth connector guide 22 and the earth connector 18 before connecting to the mounting rail 24 at the rail earth connector 26. FIG. 10 illustrates a bottom view showing the earth connector guide 22 and earth connector 18 connected to the mounting rail 24 at the rail earth connector 26.

As illustrated in FIG. 1, the terminal block 10 is secured to the mounting rail by front lip 28, located proximate the service side of the terminal block, rear clip 30, located proximate the exchange side of the terminal block, and earth connector guide 22. Front lip 28 has an inner ledge which secures the front of the terminal block by capturing the mounting rail between itself and the bottom structure of the terminal block. Rear clip 30 provides an inner ledge which secures the rear of the terminal block to the mounting rail 24. Terminal block earth connector guide 22 (as illustrated in FIG. 9) and rail earth connector 26 guide the terminal block onto the mounting rail 24. The terminal block is secured to the mounting rail by first securing the front clip 28 to the mounting rail. Once terminal block earth connector 18 and earth connector guide 22 have been properly aligned with rail earth connector 26, downward pressure is applied to the rear portion of the terminal block to urge the rear clip 30 over the edge of the mounting rail until the rear clip engages the mounting rail—snapping the terminal block firmly in place. The earth connection is made as the terminal block snaps into place.

Depending on the application of the terminal block, the mounting may include only the front lip 28 and the rear clip 30, in those applications where an earth connection is not required. In addition, the use of alternate mounting apparatus are contemplated instead of the clip and lip combination such as fastening the terminal block to the mounting rail using a clipping mechanism at both ends of the terminal block; fastening the terminal block by reversing the locations of the clip and the lip at the ends of the terminal block; or, fastening the terminal block to the mounting rail using an industrial hook and eye fastener such as VELCRO.

In order to remove the terminal block 10 of the present invention from the mounting rail 24, any flat ended tool such as a screwdriver may be used to apply force, prying the rear clip 30 away from the mounting rail 24, such that the rear clip 30 may be disengaged from the mounting rail 24 and the entire terminal block released from the mounting rail.

In this manner any number of terminal blocks may be ganged together along a mounting rail to provide access to additional service wires from a splice cable secured to an exchange distribution cable, as required. In this embodiment, a single terminal block would be provided for each exchange wire pair and service wire pair. Depending on the configuration, a single mounting rail may be used or multiple mounting rails may be used. The terminal blocks may be snapped into place along the mounting rail 24 or removed to alter the number of terminal blocks as needed. In addition, as will be discussed in more detail below, the exchange side wires of the terminal block and the service side wires of the terminal block may be repeatedly connected and disconnected.

Also, for other types of applications, a single service wire opening instead of a pair of openings 12 may be employed for each terminal block, or additional service wire openings could be provided into each terminal block if a need arose in a specific application. Accordingly, the configuration of service wire openings and their configuration on the mounting rail 24 is an illustrative preferred embodiment only and may be varied with the specific application as needed.

Still referring to FIG. 1, the top of each housing 12 includes a terminal actuator 32. As will be discussed in more detail below, the remainder of the actuator 32 extends through the housing 12 into the service side internal chamber. As illustrated in FIG. 1 by the position where terminal actuator 32 has been omitted for illustration, the actuator 32 protrudes from the interior of the housing 12 through opening 34 in housing 12. Terminal actuator 32 is preferably made of a dielectric material which may be the same as housing 12. The top of the terminal actuator 32 preferably has a shape which may be readily engaged and turned by a hand held screw driver, wrench or other implement. Alternatively, actuator 32 may be adapted to be grasped and turned by a user of the terminal block. Turning the actuator a fixed amount, preferably indicated by visual markings on the housing and actuator, effects the connection of the service wires to the exchange wires in a manner to be discussed in more detail below.

Figure 2:
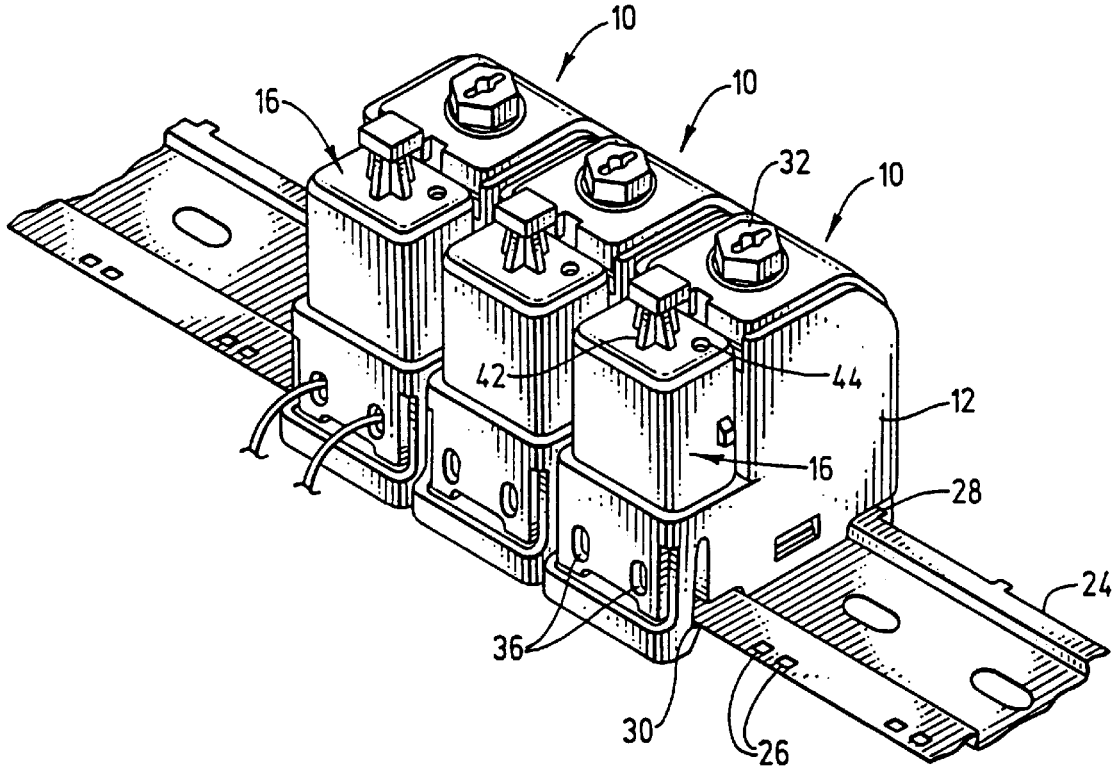
FIG. 2 is a perspective view of an exchange side of a preferred embodiment of a plurality of the modular terminal block system of the present invention showing a pair of exchange side wires connected to one terminal block.

Referring to FIG. 2, a plurality of a preferred embodiment of the terminal block of the present invention, showing the exchange side, are illustrated. The terminal block 10 of the present invention employs a terminal block housing 12 having exchange wire pair openings 36 along a rear surface thereof. As will be discussed in more detail below, the exchange wire pair openings 36 provide exchange wires with access into an internal chamber within housing 12.

Also, for other types of applications, a single exchange wire opening instead of a pair of openings 36 may be employed for each terminal block, or additional exchange wire openings could be provided into each terminal block if a need arose in a specific application. Accordingly, the configuration of exchange wire openings and their configuration on the mounting rail 24 is an illustrative preferred embodiment only and may be varied with the specific application as needed.

As further illustrated in FIG. 2, the terminal block 10 includes a linking module 16 which has a cap 42 with two "tee-in" test ports 44 (as shown in FIG. 1). As will be discussed in more detail below, the linking module 16 provides the connection between the service side and the exchange side of the terminal block and may be embodied in a number of configurations. Preferably the linking module includes a basic configuration referred to herein as a bridge module having contacts (shown in FIG. 4) which provide a connection between the service side wires and exchange side wires. An alternate embodiment of the linking module, referred to herein as a protector module, protects the service and exchange wires from voltage spikes. Both the bridge module and the protector module provide test ports 44 to allow testing of the service and exchange sides without opening the terminal block or disconnecting the service or exchange side wires.

Referring to FIG. 3, an exploded view of the basic components of a terminal block housing including the exchange side wire carrier and the service side wire carrier of the present invention is illustrated. The terminal block of the present invention includes a path for each of two wire connections between the exchange side and the service side. To simplify the description, and to avoid unnecessarily cluttering the drawings, only those components defining a single conductive path through the terminal block are described, although the detailed description applies equally to both conductive paths.

As illustrated, the exchange wire carrier 20 includes an exchange wire conduit 92 which carries the exchange wire after the exchange wire has been inserted into one of the exchange wire pair openings 36 (as illustrated in FIG. 2). The exchange wire carrier 20 includes a contact blade receiving slot 94, for receiving the exchange wire contact blade (as described below) and earth connector receiving slot 98 which terminates at the earth connector guide 22 and which receives the earth connector (not shown).

A service wire carrier 50 is provided which is threadedly engaged with the terminal actuator 32. More particularly, the service wire carrier 50 has a threaded opening 34 in the top end thereof for receiving the matching size threaded end of terminal actuator 32. The terminal actuator 32 includes a plug 54 used to retain the insulating media within housing 12 as will be described later. The service wire carrier 50 also has a wire receiving opening 56 for receiving a service wire inserted into the housing. The wire receiving opening 56 is sealed with a perforated seal 58 intended to retain the insulating media within housing 12 as will be described below.

Each wire receiving opening 56 extends through a flanged extension 60 of the service wire carrier 50 into the central portion of the carrier 50. A first contact blade receiving slot 62 is provided in the carrier at a first position along opening 56 and a second contact blade receiving slot 64 is provided at a second position along opening 56. The first and second contact blade receiving slots 62, 64, respectively, receive first and second insulation cutting contact blades 66, 68. The service wire carrier 50, including the first and second insulation cutting contact blades 66, 68 is retained within the terminal block housing insert 70.

Housing insert 70 includes first and second contact blade retaining slots 72, 74, respectively, for each set of contact blades. The first and second contact blade retaining slots receive first and second insulation cutting contact blades 66, 68. Housing insert 70 also retains the service wire junction contact 76. Each service wire junction contact 76 is integrally formed with the first and second insulation cutting contact blades 66, 68. Therefore, when either of the insulation cutting contact blades 66, 68 is in conductive communication with a service wire, it is also in conductive communication with the corresponding service wire junction contact 76.

As illustrated in FIG. 4, the housing insert 70 retains the exchange wire junction contact 80 and earth junction contact 84 in addition to junction contact 76. These junction contacts are inserted into the base of the five-prong access jack 120 when the housing insert is placed into the housing 12. More particularly, the service wire junction contact 76 is retained within service wire junction contact slot 122 and the exchange wire junction contact 80 is retained within the exchange wire junction contact slot 124. Earth junction contact 84 is retained within the centrally situated earth junction contact slot 130.

As illustrated in FIG. 4, the exchange wire carrier 20 is inserted into a space formed between the housing 12 and the housing insert 70 into the housing 12. Upon insertion, the exchange wire contact blade receiving slot 94, receives the exchange wire insulation cutting contact blade 170. The insulation cutting contact blade 170 is integrally formed with the exchange wire junction contact 80 and of a metallic conductor to provide good electrical contact from the junction contact 80 to the exchange wire when the insulation cutting contact blade 170 pierces the insulation thereof during termination as described below.

As illustrated in FIG. 4, the terminal block of the present invention includes a bridge module 40 embodiment of the linking module. The bridge module 40 includes a path for each of two wire connections between the exchange side and the service side. To simplify the description, and to avoid unnecessarily cluttering the drawings, only those components defining a single conductive path through the bridge module are described, although the detailed description applies equally to both conductive paths.

The bridge module 40 includes a set of integrally formed bridge contacts 110. Each set of bridge contacts 110 includes a service wire junction contact 114 and an exchange wire junction contact 116. The contacts are maintained within the bridge module with a hard encapsulant such as a non-conductive epoxy, the top surface of which is illustrated as encapsulant 38. The hard encapsulant only occupies a portion of the interior of the bridge module 40. The remainder of the interior of the bridge module 40, comprising approximately the top third of the interior of the bridge module 40, is filled with an insulating gel. Therefore a test probe may be inserted into tee-in test port 44 to make conductive contact with the set of bridge contacts 110.

FIG. 4 also illustrates the gasket 118 which is used to provide a seal between the selected linking module and the five-prong access jack 120 of the housing 12. The gasket is constructed of an elastic material known in the art and capable of serving as an environmental barrier between the five-prong access jack 120 and the external environment. The gasket provides a seal such that once the linking module is snapped into place over the five-prong access jack 120, no environmental contaminants or moisture may enter the junction contact area.

Figure 5:
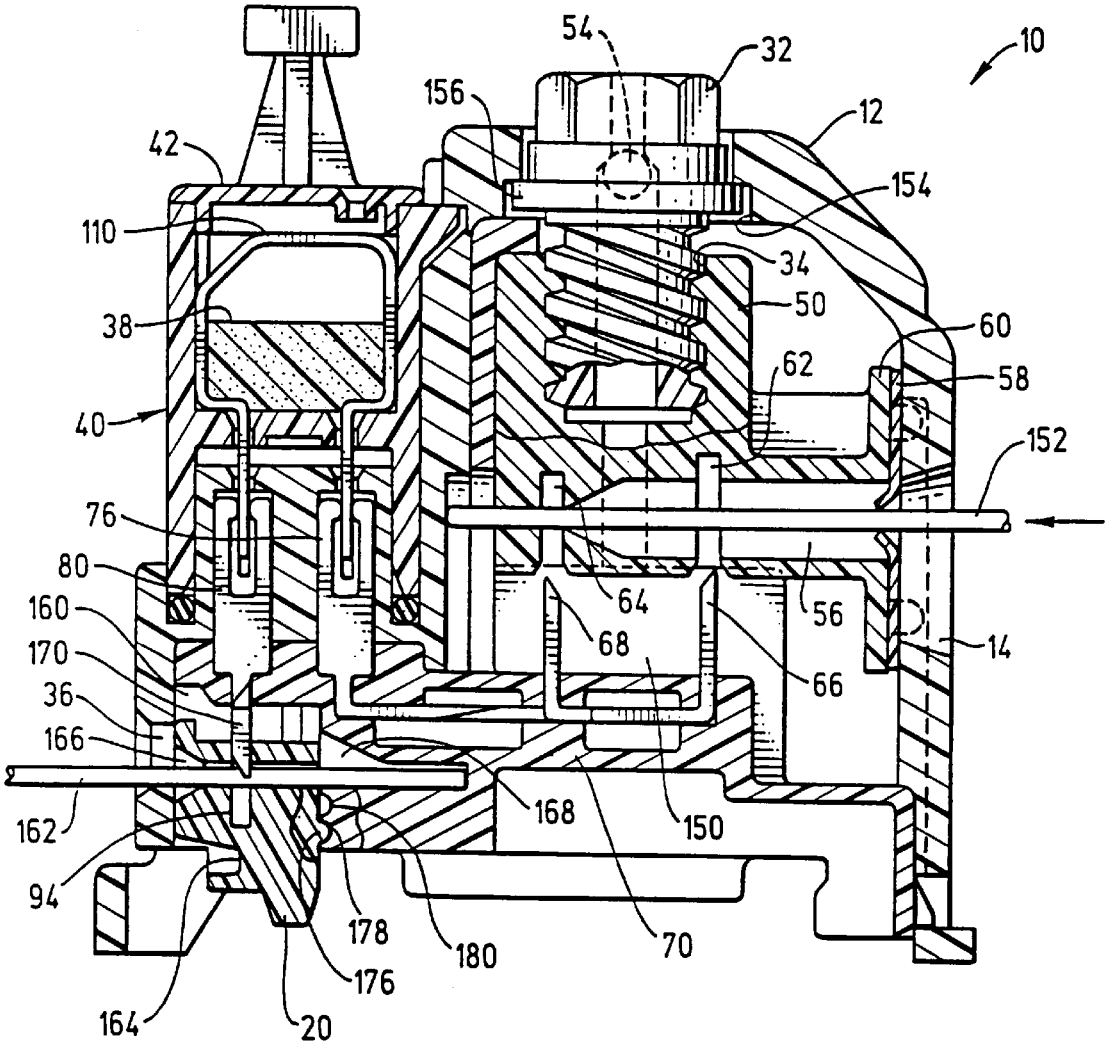
FIG. 5 is a broken away view showing an interior of a terminal block in accordance with the present invention, illustrating an exchange side wire carrier position before terminating an exchange wire and a service side wire carrier position before terminating a service wire.
Figure 6:
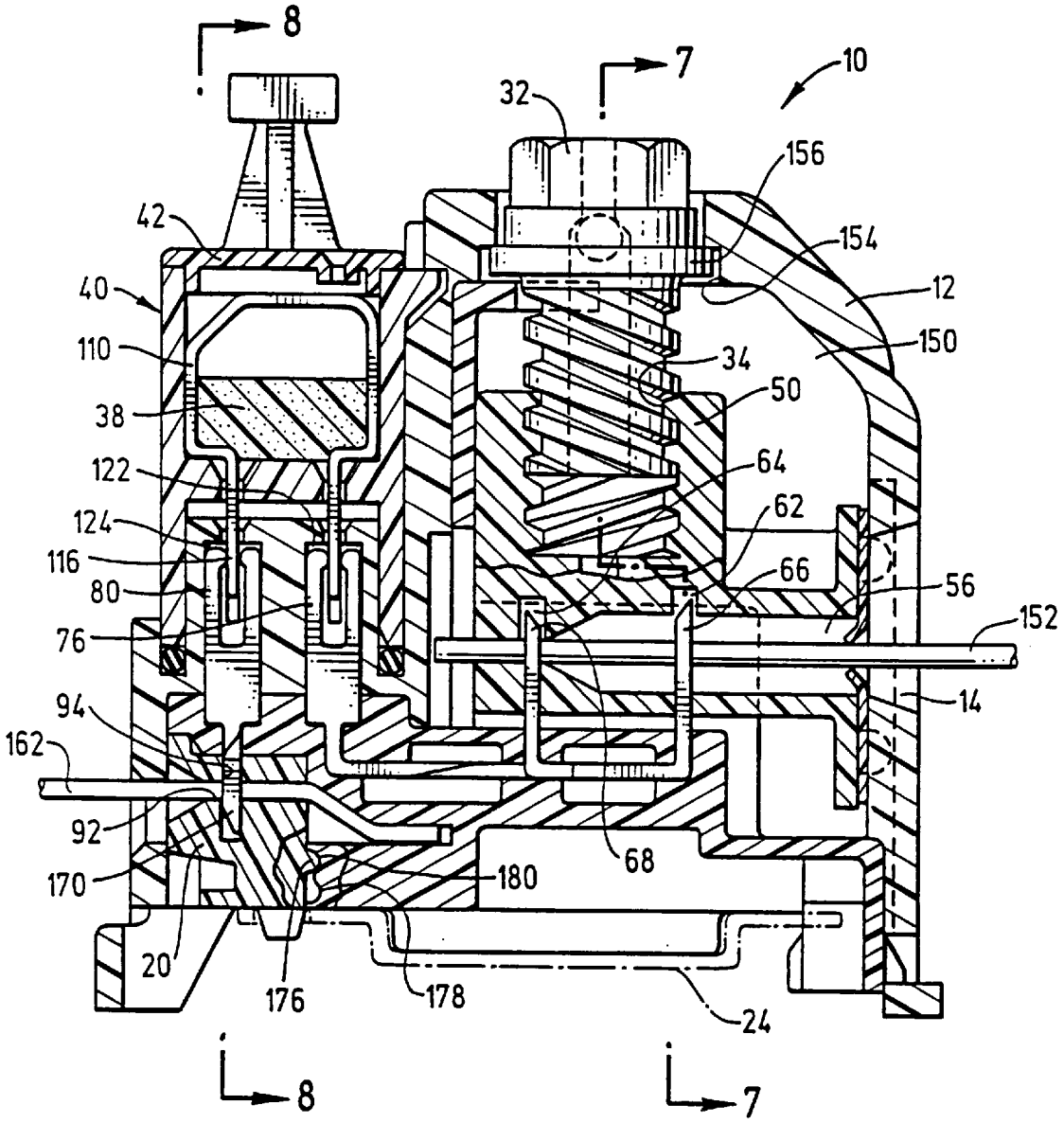
FIG. 6 is a broken away view showing an interior of a terminal block in accordance with the present invention, illustrating an exchange side wire carrier position after terminating an exchange wire and a service side wire carrier position after terminating a service wire.
Figure 8:
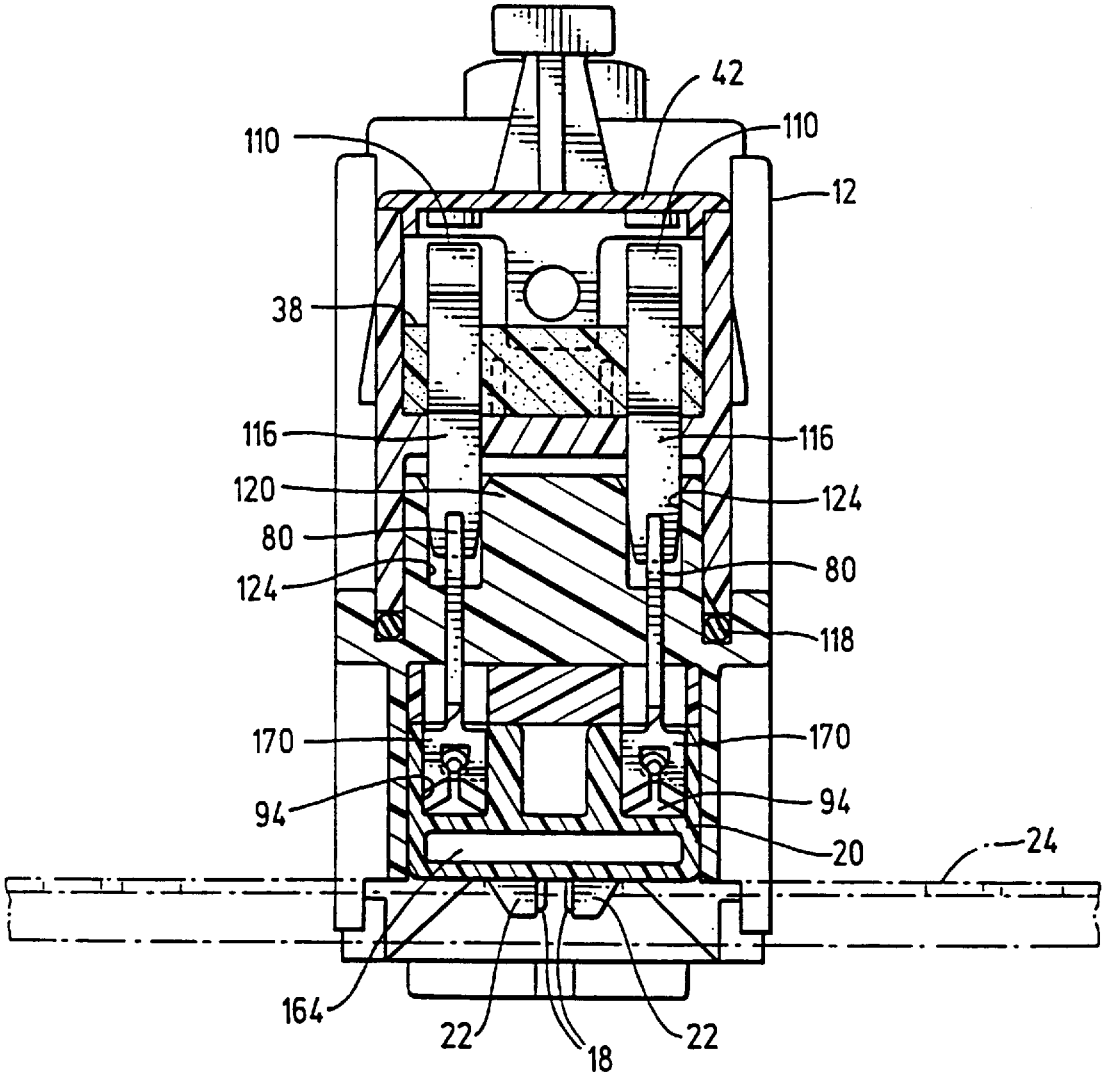
FIG. 8 shows a cut-away view taken along line 8—8 of FIG. 6 showing a cross-section of the exchange side wire carrier in accordance with the present invention.

As best illustrated in FIGS. 5, 6 and 8, installation of an exchange wire on the exchange side is illustrated. FIG. 5 shows a broken away view showing an interior of the terminal block of the present invention illustrating the exchange side wire carrier position before terminating an exchange wire. In regard to the installation of the exchange side wire, an internal exchange side chamber 160 is preferably formed with the bottom and rear of housing insert 70, sides and rear of housing 12 and top of exchange wire carrier 20. The exchange wire carrier 20 is retained in place within the chamber through the combined action of the exchange wire carrier retaining stub 176 (as shown in FIG. 3) in correspondence with first or second exchange wire carrier retaining slots 178, 180. The exchange wire carrier 20 may be moved into an open or closed position by exchange wire carrier actuator slot 164 which is integrally formed with the exchange wire carrier 20. The actuator slot 164 may be manipulated by a simple tool such as a screwdriver to push the exchange wire carrier away from the roof of the housing 12 into the open position, as shown in FIG. 5, thus opening the exchange wire chamber 160. In the open position the exchange wire carrier is retained by the exchange wire carrier retaining stub 176 and exchange wire carrier retaining slot 178.

Once the exchange wire carrier 20 is moved into the open position, the exchange wire 162 may enter the exchange wire opening 36 in the housing 12 and travel into the exchange wire receiving opening 166 in the exchange wire carrier 20 and finally into the exchange wire receiving opening 168 of the housing insert 70 until seated at the base of the opening. Preferably, if both conductive paths are to be used, both exchange side wires are inserted into the exchange side wire carrier before the terminal block is snapped into place on the mounting rail.

FIG. 6 shows a broken away view of the interior of the terminal block of the present invention, illustrating the exchange side wire carrier position after terminating an exchange wire. FIG. 8 shows a second view which is a cross-section of the exchange side wire carrier after terminating an exchange wire taken along line 8—8 of FIG. 6. The exchange wire may be terminated, as illustrated, when the terminal block 10 is snapped into place onto the mounting rail 24. Installing the terminal block 10 onto the mounting rail forces the exchange wire carrier 20 upwards, into the closed position. In pushing the exchange wire carrier upwards, the exchange wire carrier retaining stub 176 is forced out of exchange wire carrier retaining slot 178 and into exchange wire carrier retaining slot 180. The exchange wire may also be terminated by pushing the exchange wire carrier into the closed position manually and then installing the terminal block onto the mounting rail.

In closing the exchange wire carrier, the exchange wire is put in conductive communication with the exchange wire junction contact 80 as follows. The exchange wire 162 is seated in the exchange wire conduit 92. As the exchange wire carrier is forced upwards into the closed position, the exchange wire insulation cutting contact blade 170 is forced into the exchange wire 162 while traveling into the exchange wire contact blade receiving slot 94. The insulation cutting contact blade 170 cuts through the exchange wire insulation and makes contact with the metallic conductor of the wire. The exchange wire junction contact 80 is simultaneously put in conductive communication with the exchange wire because it is in conductive communication with the insulation cutting contact blade 170.

Figure 7:
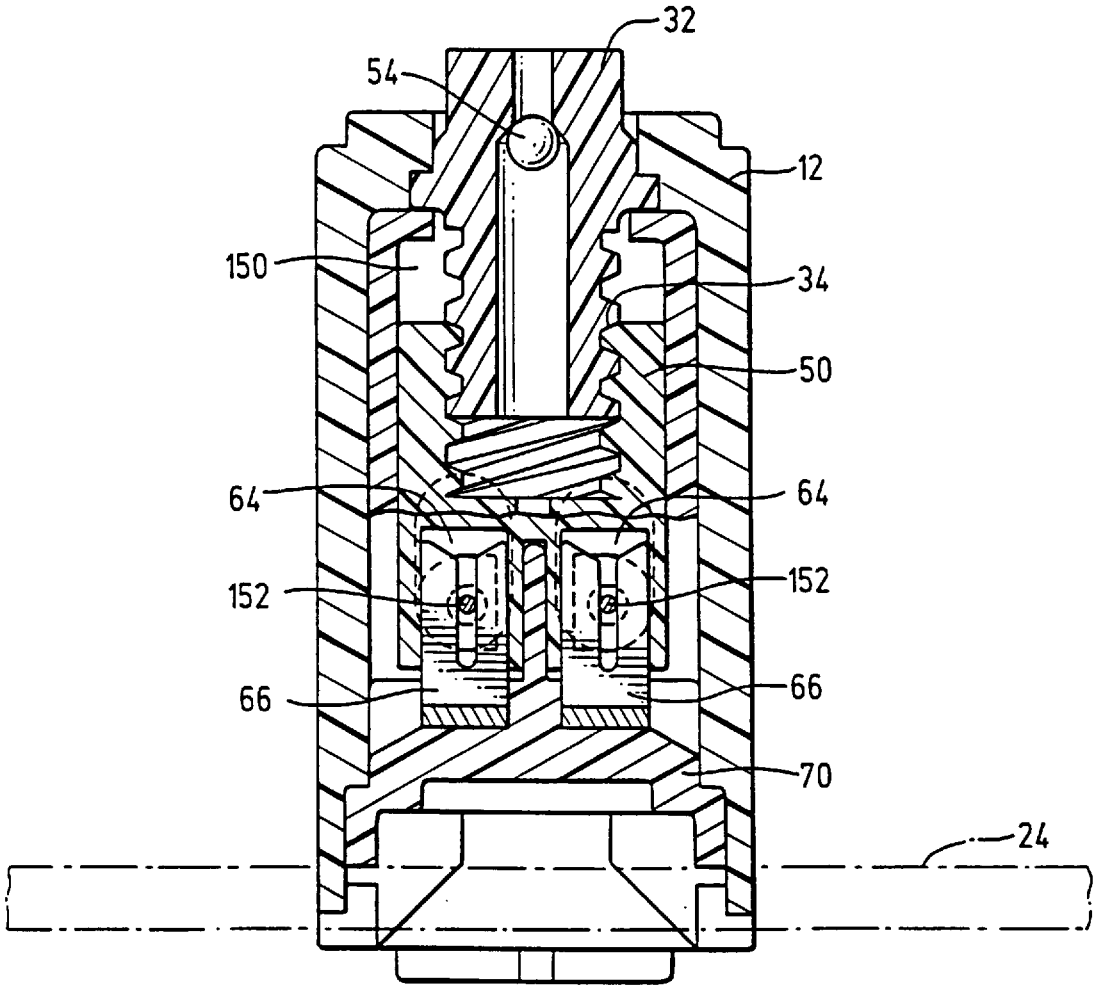
FIG. 7 shows a cut-away view taken along line 7—7 of FIG. 6 showing a cross-section of an actuator and the service side wire carrier in accordance with the present invention.

FIGS. 5, 6 and 7 illustrate installation of a service wire on the service side. As best illustrated in FIG. 5, a broken away view showing an interior of the terminal block of the present invention illustrates the service side wire carrier position before terminating a service wire. As illustrated, an internal service side chamber 150 is preferably integrally formed with the tops and sides of housing 12 and the top of housing insert 70. The service wire carrier 50 is opened by turning the terminal actuator 32 until the service wire carrier 50 has been fully retracted towards the roof of the housing 12. Once the service wire carrier 50 has been retracted into the open position, the service side wire 152 may enter the perforated seal 58 and travel into the service wire receiving opening 56 until seated at the base of the opening. In practice both service side wires are inserted into the service side wire carrier before terminal actuator 32 is used to terminate the wires.

FIG. 6 illustrates the service side wire carrier position after terminating a service wire and FIG. 7 shows a second view which is a cross-section of the terminal actuator and the service side wire carrier after terminating a service wire taken along line 7—7 of FIG. 6. As illustrated, the first and second contact blade receiving slots 62, 64, respectively, receive first and second insulation cutting contact blades 66, 68, when the service wire carrier 50 is in the closed position. The first and second insulation cutting contact blades 66, 68 are each integrally formed with a service wire junction contact 76 and are formed of a metallic conductor to provide good electrical contact from the service wire junction contact 76 to the service wire when blades 66, 68 pierce the insulation thereof. Therefore, once an insulation cutting contact blade is in conductive communication with a service wire, it is also in conductive communication with the corresponding service wire junction contact 76.

Which of the two blades 66, 68 makes electrical contact to the wires is determined by the diameter of the wire. That is, whether the wire is inserted to the first slot 62 or second slot 64 will depend on the wire diameter. For example, as illustrated in FIG. 6, a large gauge wire will only proceed along opening 56 far enough to reach slot 62 and will thus make electrical contact with blade 66. A smaller gauge wire in turn will reach to second slot 64 and make contact with the second, longer blade 68.

As best illustrated in FIG. 6, the top portion of housing 12 over the chamber 150 is provided with an annular groove 154 around opening 34. The top end of terminal actuator 32 is provided with a matching annular flange 156 which fits within the annular groove 154. This thus prevents vertical motion of the terminal actuator 32 during rotation thereof, in contrast to prior art actuator type connectors which screw down into a receptacle to make contact with a service wire.

As best illustrated in FIG. 4, once the exchange and service wires have been terminated as described in FIGS. 5–8, the exchange wire is conductively connected to exchange wire junction contact 80 at exchange wire junction contact slot 124 in the five-prong access jack 120. The service wire is conductively connected to service wire junction contact 76 at service wire junction contact slot 122 in the five-prong access jack 120. The earth connector 18 is conductively connected to the earth junction contact 84 at earth junction contact slot 130.

In order to conductively connect the service side to the exchange side using the bridge module 40, the bridge module 40 is plugged into the five-prong access jack 120. The set of bridge contacts 110 complete the conductive loop between the exchange side and the service side. Once connected, the tee-in test port 44 (as shown in FIG. 2) may be used to perform diagnostic testing with which to examine the signal provided by the connection.

Figure 11:
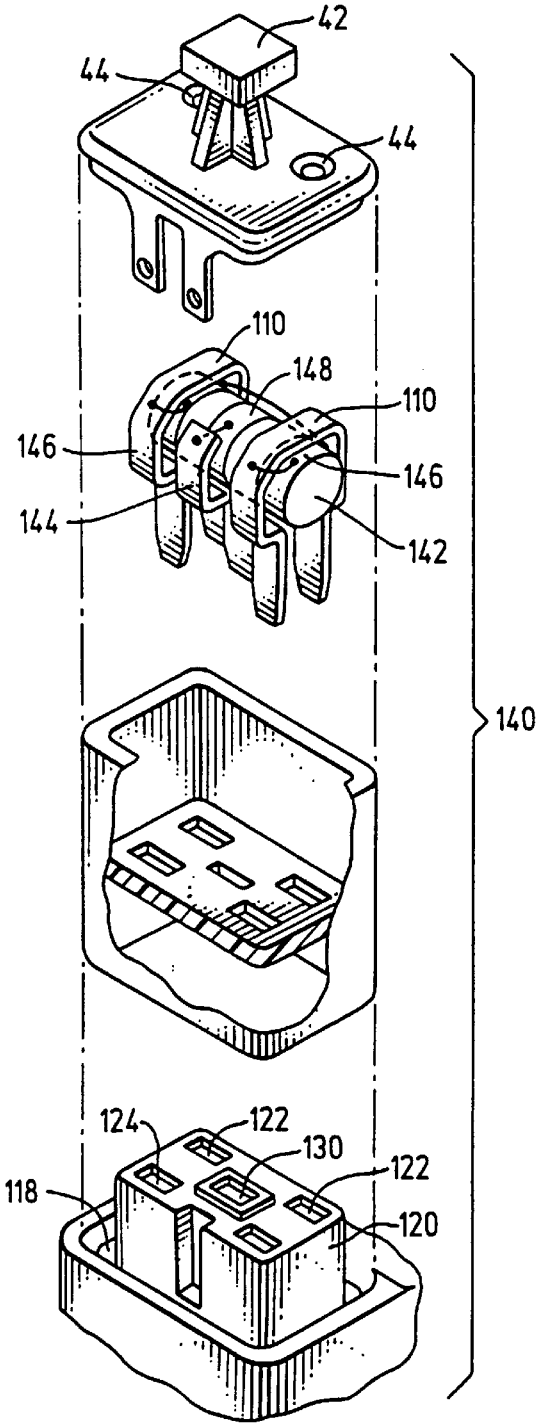
FIG. 11 is an exploded view of the basic components of the protector module in accordance with an alternate embodiment of the present invention.

In the alternative, the bridge module may be removed and replaced with a protector module 140 as illustrated in FIG. 11. The protector module 140 performs the same function as bridge module 40, in terms of connecting the service and exchange sides when plugged into the five-prong access jack 120, but also includes a gas discharge tube 142 and an earth junction contact 144. The gas discharge tube 142 has three conductive rings, one ring 146 encircling the circumference of each of the ends of the tube and a third ring 148 encircling the middle of the tube. Each of the rings is soldered or conductively secured to a contact. Therefore, each set of contacts 110 are conductively connected to the end rings, respectively, and the earth junction contact 144 is conductively connected to the middle ring. Among its many functions, the gas discharge tube 142 and earth junction contact connection 144 perform in conjunction with contacts 110 to shunt voltage to earth in the event there are voltage spikes on the conductive path, for example. Therefore, once the protector module is plugged into the five-prong access jack 120, the two primary conductive paths between the exchange side and the service side are protected from intermittent destructive voltage levels. The use and operation of the gas discharge tube and its application in protecting signal lines in this manner are well known in the art.

As in the bridge module 40 of the present invention, the contacts 110 and the gas discharge tube 142 within the protector module 140 are maintained within the protector module with a hard encapsulant such as a non-conductive epoxy. The hard encapsulant only occupies a portion of the interior of the protector module 140, as used in the bridge module. The remaining top third of the interior of the protector module 140 is filled with an insulating media. Therefore a test probe may be inserted into tee-in test port 44 to make conductive contact with the set of contacts 110 to perform diagnostic tests on the connection. The bridge module 40 and the protector module 140 may be used interchangeably with the housing 12, and the five-prong access jack 120, depending on the application desired by the user.

Figure 12:
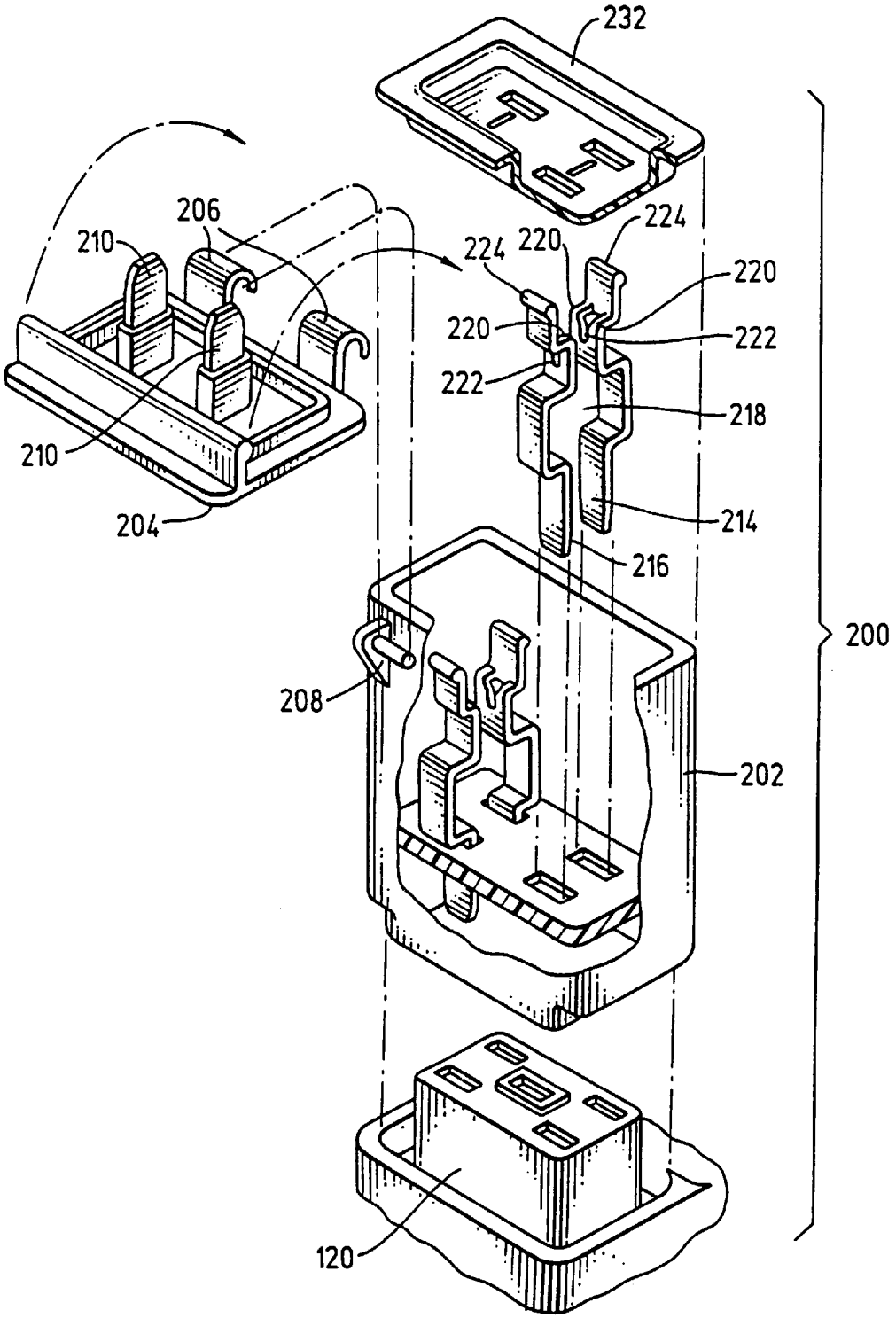
FIG. 12 is an exploded view of the basic components of the two-way testing module in accordance with an alternate embodiment of the present invention.

In the alternative, the bridge module may be removed and replaced with a two-way testing module 200 as illustrated in FIG. 12. The two-way testing module performs the same function as the bridge module 40, in terms of connecting the service and exchange sides when plugged into the five-prong access jack 120, but includes a configuration of the contacts which permits testing either the exchange side or the service side without disconnecting the exchange side or service side wires. The two-way testing module also includes a protected embodiment which is further described below.

The two-way testing module 200 includes a path for each of two wire connections between the exchange side and the service side. To simplify the description, and to avoid unnecessarily cluttering the drawings, only those components defining a single conductive path through the two-way testing module are described, although the detailed description applies equally to both conductive paths.

The two-way testing module 200 includes a housing 202 and a hinged cover 204. The testing module housing 202 and cover 204 are preferably made of a dielectric material which may be the same as housing 12 (as illustrated in FIG. 1). The hinges 206 are integrally formed with cover 204 so that hinges and cover comprise a single unit. The hinged cover 204 is rotatably secured to the housing by pins 208 which are integrally formed with the housing. The hinged cover 204 includes bayonet contacts 210 which are secured perpendicular to the interior of the hinged cover and formed of a metallic, conductive material such as brass, although other sufficiently conductive materials would perform adequately.

Within housing 202 are secured two sets of test contacts. Each set of test contacts includes a service wire test contact 214 and an exchange wire test contact 216. Each contact is formed of a metallic, conductive material similar to that of the bayonet contact 210. Each contact has a plurality of bends. One set of bends create an area 218 into which a twin gas discharge tube may be inserted for a protected embodiment of the two-way testing module (described further below). A second set of bends 220 are provided in correspondence with a slot 222 in each contact which permits the insertion of the bayonet contact 210 simultaneously into the service wire test contact 214 and the exchange wire test contact 216. The top end of the service wire test contact 214 and the exchange wire test contact 216, proximate the cover 204, conclude in a lip 224 which provides a convenient grip with which to affix an alligator-type test lead, or other similar test lead, for testing of either the service side or the exchange side.

Figure 13:
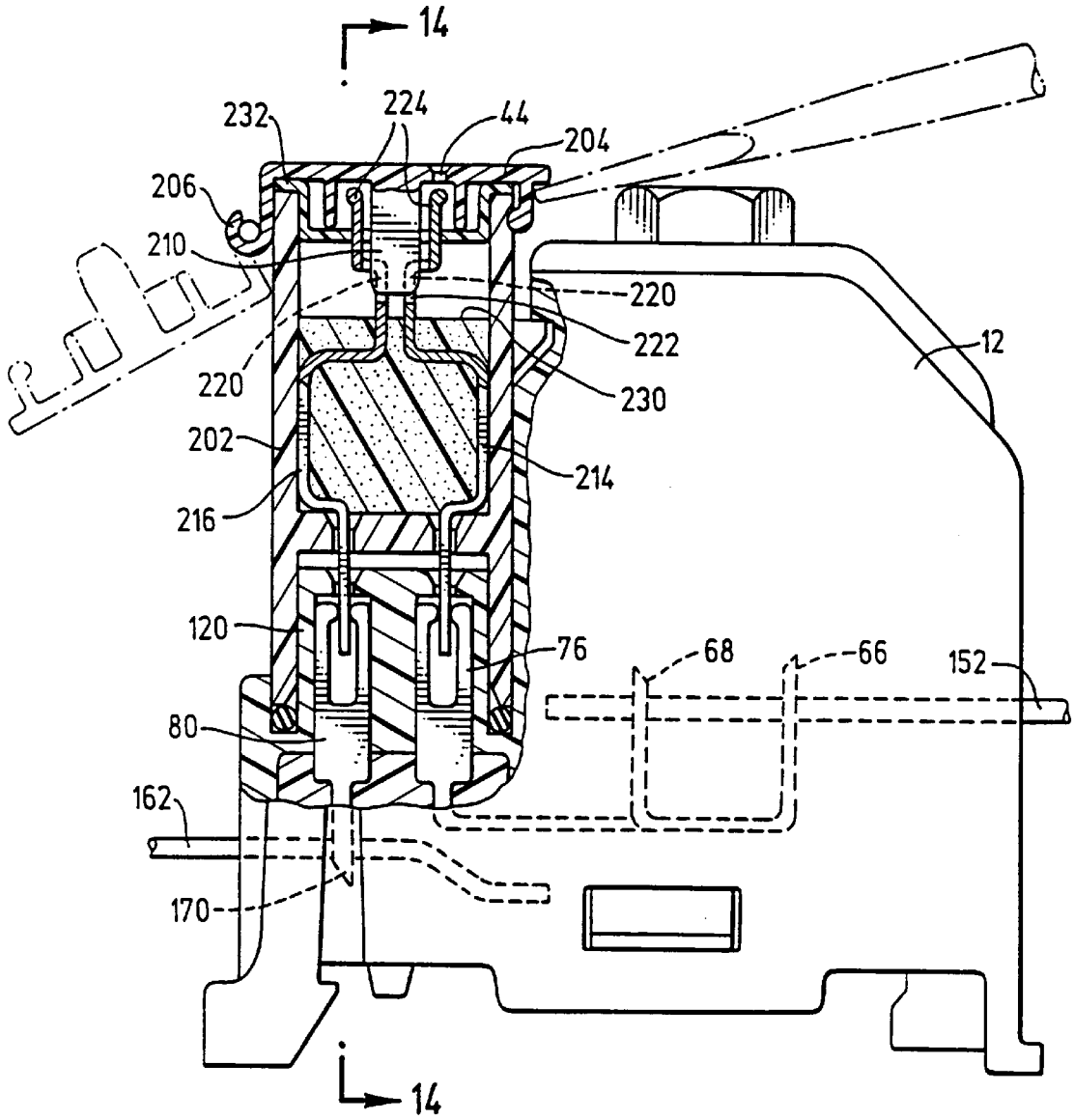
FIG. 13 is a broken away view showing an interior of a two-way testing module in accordance with an alternate embodiment of the present invention.
Figure 14:
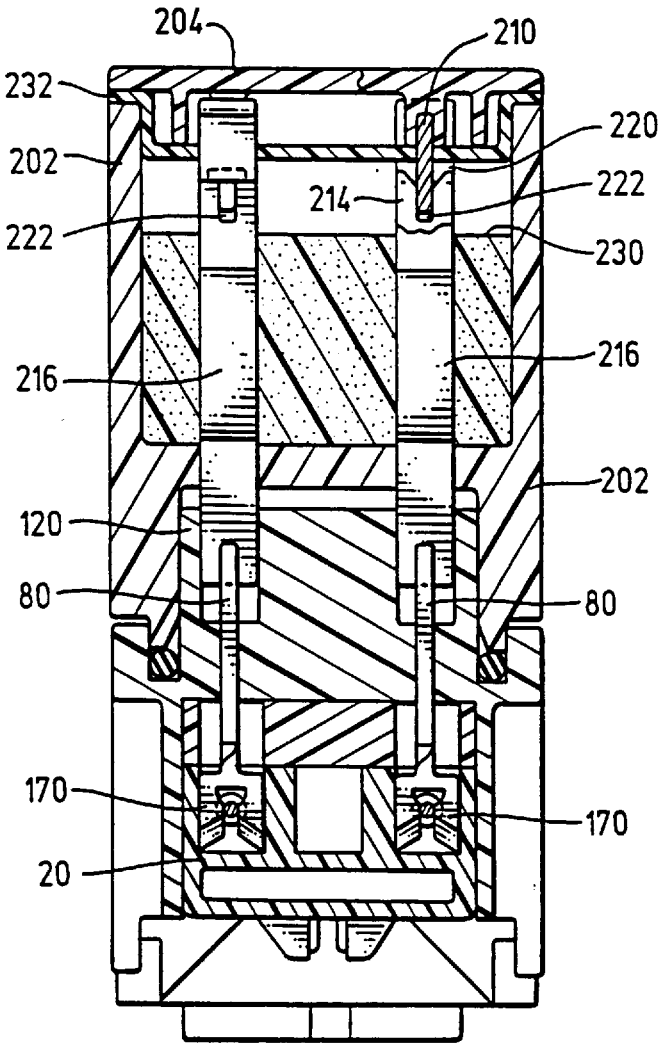
FIG. 14 shows a cut-away view taken along line 14—14 of FIG. 13 showing a cross-section of a two-way testing module in accordance with an alternate embodiment of the present invention.

FIG. 13 is a broken away view showing an interior of a two-way testing module. FIG. 14 shows a cut-away view taken along line 14—14 of FIG. 13 showing a cross-section of the two-way testing module 200. As illustrated in FIG. 13, the contacts are maintained within the two-way testing module 200 with a hard encapsulant such as a non-conductive epoxy, the top surface of which is illustrated as encapsulant 230. The hard encapsulant occupies a portion of the interior of the two-way testing module 200. The remainder of the interior of the two-way testing module 200 is sealed by gasket 232. The gasket is secured to the top edge of the housing 202. When the cover 204 is closed, the gasket 232 provides a seal between the cover 204 and the housing 202 such that an environmental seal is formed which protects the contents of the two-way testing module from the environment. More particularly, the gasket 232 provides an environmental shield which protects the junction between the service wire test contact 214, the exchange wire test contact 216 and the bayonet contact 210. Therefore the connection between the service side and the exchange side, formed when the cover is closed and the bayonet contact is inserted into the slot 222 provided in the service wire test contact 214 and the exchange wire test contact 216, is protected from the environment by the gasket. Preferably, the interstitial space between the encapsulant and the gasket is filled with an insulating media which further protects the junction from the environment.

As illustrated in FIG. 13, the cover 204 may be pried open with the help of any flat tool such as a screwdriver. Once opened, a lip 224 located on the top of each contact, is exposed above the gasket 232 so that an alligator-type or equivalent test connector can be conveniently connected to either the service wire test contact 214 or the exchange wire test contact 216 for testing. Even when the two-way testing module is in the open position the contents of the module below the gasket are substantially protected from the environment because only the two slots normally filled with the bayonet contacts are open.

The cover may be provided with a tee-in test port 44. Therefore, a test probe may be inserted into the tee-in test port 44 to make conductive contact with the service and exchange sides once they are connected by the bayonet contact, without opening the two-way testing module cover.

Figure 15:
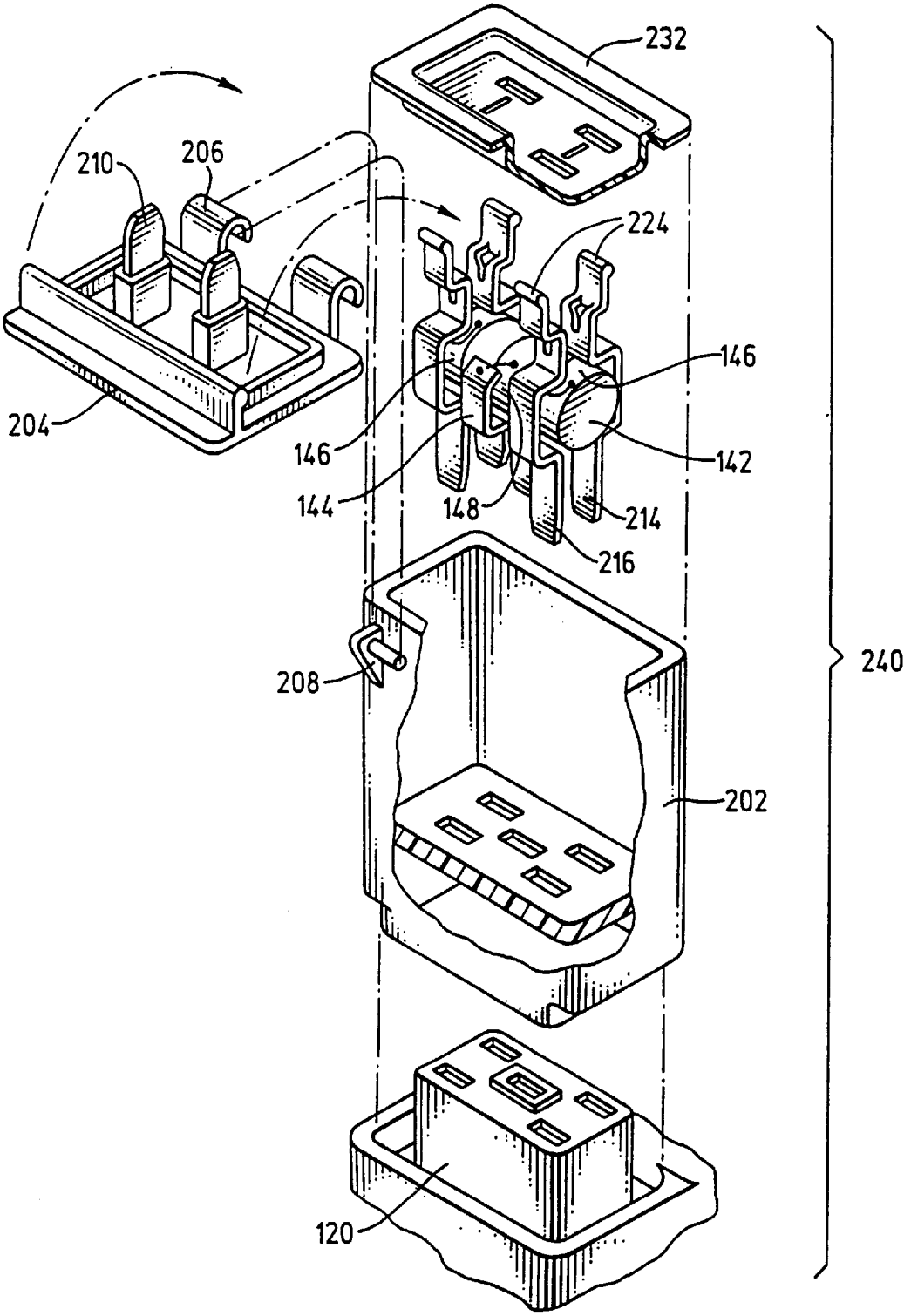
FIG. 15 is an exploded view of the basic components of the protected two-way testing module in accordance with an alternate embodiment of the present invention.

In the alternative, the two-way testing module 200 may be removed and replaced with a protected two-way testing module 240 as illustrated in FIG. 15. The protected two-way testing module 240 performs the same function as two-way testing module 200, in terms of connecting the service and exchange sides when plugged into the five-prong access jack 120, but also includes a gas discharge tube 142 and an earth junction contact 144, which perform substantially as described in association with FIG. 11.

The gas discharge tube 142 has three conductive rings, one ring 146 encircling the circumference of each of the ends of the tube and a third ring 148 encircling the middle of the tube. Each of the rings is soldered or conductively secured to a contact. Therefore, in one embodiment, the exchange wire test contacts 216 are conductively connected to the end rings, respectively, and the earth junction contact 144 is conductively connected to the middle ring 148. In the alternative, the service wire test contacts 214 are conductively connected to the end rings, respectively, and the earth junction contact 144 is conductively connected to the middle ring. Therefore, once the protected two-way testing module is plugged into the five-prong access jack 120, and cover 204 is in the closed position, the two primary conductive paths between the exchange side and the service side are protected from intermittent destructive voltage levels. The use and operation of the gas discharge tube and its application in protecting signal lines in this manner are well known in the art.

When the cover of the protected two-way testing module is in the open position, lip 224 located on the top of each contact, is exposed above the gasket 232 so that an alligator-type or equivalent test connector can be conveniently connected to either the service wire test contact 214 or the exchange wire test contact 216 for testing.

As in the two-way testing module 200, the service wire and exchange wire test contacts 214 and 216, the earth junction contact 144 and the gas discharge tube 142 are maintained within the protected two-way testing module 240 with a hard encapsulant such as a non-conductive epoxy. The hard encapsulant only occupies a portion of the interior of the protected two-way testing module 240, as in the two-way testing module 200. The remainder of the interior of the two-way testing module 240 is sealed by gasket 232. The gasket 232 protects the junction between the service wire test contact 214, the exchange wire test contact 216 and the bayonet contact 210. Therefore the connection between the service side and the exchange side, formed when the cover is closed and the bayonet contact is inserted into the slot 222 provided in the service wire test contact 214 and the exchange wire test contact 216, is protected from the environment by the gasket 232. Preferably, the interstitial space between the encapsulant and the gasket is filled with an insulating media which further protects the junction from the environment.

In addition, a test probe may be inserted into tee-in test port 44, when the cover is in the closed position, to perform diagnostic tests on the connection between the service side and the exchange side while maintaining the conductive connection between the two sides. The two-way testing module 200 and the protected two-way testing module 240 may be used interchangeably with the housing 12, and the five-prong access jack 120, depending on the application desired by the user.

Referring to FIG. 5, prior to use of the terminal block of the present invention for exchange wire and service wire connection, and preferably during manufacture or assembly of the terminal block, a suitable insulating medium is injected into chambers 150 and 160 and above the hard encapsulant within the bridge module 40 and the protector module 140 so as to fill all the voids and the wire openings in the terminal block. In addition, the voids in the two-way testing module 200 or the protected two-way testing module 240 may also be filled in a similar manner. Any one of a large number of well known commercially available greases, gels and other insulating mediums may be employed, depending on the specific requirements of the application.

The viscosity and adhesive qualities of the medium should be such that wires may be inserted to and removed from openings 56, 166 and 44 without adhering excessively to the medium. The medium should be sufficiently flowable so as to flow around the exchange wire carrier 20 and the service wire carrier 50 as they move therethrough. The medium may be injected into the chamber 150 through terminal actuator 32 through a central bore therein. This central bore in terminal actuator 32 is then secured with a plug 54 to ensure the medium 28 remains within the chamber once the chamber is filled. Similarly, perforated seal 58 also helps prevent the medium from flowing out through the service wire receiving openings 56. The medium is also injected into test port 44 in order to fill the bridge module 40 and the protector module 140 and into chamber 160 through exchange wire receiving opening 166. The medium is also injected through the gasket 232 to fill the two-way testing module 200 and the protected two-way testing module 240. Injection of the medium may be performed after assembly of the terminal block. Also, the medium may be pumped in after being precured outside of the block in the case of a curable medium such as a gel, or may be injected in an uncured state and subsequently allowed to cure.

In the field, the exchange wires desired to be connected to the terminal block are inserted into openings 166 with the exchange wire carrier 20 configured in a first open position illustrated in FIG. 5. In this position, the wires may be readily inserted into the interior of exchange carrier 20 displacing only a very moderate amount of insulating medium. As may be appreciated from FIG. 5, in the open position, the diameter of the wire blocks the opening 166 preventing outflow of the insulating medium therethrough. Once the exchange wires have been inserted into the exchange wire openings 166, the installer simply pushes the exchange wire carrier 20 into the closed position. This may also be performed in conjunction with snapping the carrier into place on the mounting rail 24 as shown in FIG. 6. This motion drives the exchange wire carrier 20 upward. In this position, the wires have been forced into contact with exchange wire insulation cutting contact blades 170. Insulation cutting blades 170 slice through the insulation on the wires providing good electrical contact to the inner conductive core of each wire. Because of the flowable nature of the medium, as the exchange wire carrier moves from the open to closed position, the insulating medium is simply displaced from the chamber 160 to and opening 166 during closing. Thus, despite the forcing up of the exchange wire carrier 20 and the wires connected thereto, the volume of insulating medium in the chamber 160 remains substantially constant, avoiding the outflow of medium and/or the creation of any voids which could allow the entry of moisture or contaminants from the environment.

The medium is also preserved within chamber 150 when connecting and disconnecting service wires in the field. The service wires desired to be connected to the terminal block are inserted into openings 56 through perforated seal 58 with the service wire carrier 50 configured in a first position illustrated in FIG. 5. In this position, the wires may be readily inserted into the interior of carrier 50 displacing only a very moderate amount of insulating medium. As may be appreciated from FIG. 5, in the first position, the flanged extension 60 with perforated seal 58 of carrier 50 blocks the portion of wire access slots 14 below the openings 56 preventing outflow of the insulating medium therethrough. Once the wires have been inserted into the openings 56 the user of the terminal block rotates terminal actuator 32 which in turn drives the service wire carrier 50 downward due to the threaded engagement of actuator 32 and the carrier member. The medium is prevented from exiting through the center portion of the actuator by plug 54. Actuator 32 is rotated until the carrier 50 is driven down to the second position illustrated in FIG. 6. In this position, the wires have been forced into contact with insulation cutting blades 64, 66. Insulation cutting blades 64, 66 slice through the insulation on the service wire providing good electrical contact to the inner conductive core of the wire.

During the downward motion of the service wire carrier 50, from the first position shown in FIG. 5 to the second position shown in FIG. 6, the insulating medium inside chamber 150 will flow around the sides of service wire carrier 50 so as to be displaced from the bottom to the top portion of the chamber 150. In this regard, vertical channels 54 (seen most clearly in FIG. 3) may be provided on service wire carrier 50 to facilitate the flow of the insulating medium around the carrier member as it is driven from the first to second position by rotation of actuator 32. Thus, despite the forcing down of the service wire carrier 50 and the wires connected thereto, the volume of insulating medium in the chamber 150 remains substantially constant, avoiding the outflow of medium and/or the creation of any voids which could allow the entry of moisture or contaminants from the environment.

Unlike conventional terminal blocks, once installed the terminal block may be removed from the mounting rail and the exchange side wires removed and replaced as required while maintaining the insulating medium within the terminal block.

As best illustrated in FIG. 2, in order to remove the terminal block 10 from the mounting rail 24 a tool such as a screwdriver may be used to apply force, pushing the rear clip 30 away from the mounting rail, such that the rear clip 30 may be disengaged from the mounting rail 24 and the entire terminal block lifted off of the mounting rail.

As best illustrated in FIG. 5, once the terminal block is removed from the mounting rail the exchange side wires may be removed and/or replaced. In order to remove exchange side wires, downward force is applied to the exchange wire carrier 20 by inserting a flat-headed tool such as a screwdriver, into the exchange wire carrier actuator slot 164. The downward pressure forces the exchange wire carrier 20 into the open position and frees the exchange wires from the exchange wire insulation cutting contact blades 170. Once freed, the exchange wires may be removed from the terminal block. In addition, new exchange wires may be inserted into the exchange wire carrier for installation if required. As a result, the terminal block may be repeatedly used in the same or a different installation, providing maximum flexibility.

The service side wires may be removed by reversing the terminal actuator movement. Reversing the rotation of the terminal actuator forces the service wire carrier upward, disengaging the service wires from the first and second insulation cutting contact blades 64, 66. Once disengaged the wire may be pulled out of the terminal block housing. In this manner service wires may be terminated, removed and replaced in the same terminal block, as required.

Accordingly, it will be appreciated that the terminal block of the present invention provides significantly improved environmental protection and allows the multiple connection and disconnection of exchange wires and service wires to the terminal block without significant loss of insulating medium and concomitant loss of environmental protection capability. Furthermore, the present invention provides a terminal block which is simple to use and which is simple mechanically and not prone to failure even after repeated connections and disconnections. In addition, the terminal block of the present invention provides a bridge module or protector module for conveniently and safely connecting the exchange and service sides, as well as a five-prong access jack for use by additional modules as desired.

Referring to FIGS. 3 and 4, an exploded side view of the present invention is illustrated which illustrates the ease of manufacture of the present invention. As illustrated, each of the components of the terminal block within housing 12 is moved into position and captured by the housing insert 70 and the housing 12. Thus, it will be appreciated that the present invention, in addition to providing the features described above, may also be manufactured in a cost effective manner, readily compatible with existing manufacturing technologies.

While the foregoing description has been of a presently preferred embodiment of the present invention, it should be appreciated that the terminal block of the present invention may be modified in a wide variety of ways while still remaining within the spirit and scope of the present invention. For example, the specific configurations of the housing, housing insert, exchange wire carrier, earth connection on the mounting rail, and service wire carrier may all be varied due to specific manufacturing considerations or other reasons without departing from the spirit and scope of the present invention. Furthermore, while the present invention has been described as a terminal block adapted for use with insulated exchange and service side wires, the present invention may equally well be employed with bare exchange or service wires. Additional variations and modifications of the preferred embodiment described above may also be made as will be appreciated by those skilled in the art and accordingly the above description of the present invention is only illustrative in nature.

What is claimed is:

1. A terminal block for connecting a telecommunications service wire and a telecommunications exchange wire comprising:

a housing;

service wire terminating means configured in the housing, said service wire terminating means including a service wire contact element;

means for terminating an exchange wire, said exchange wire terminating means including an exchange wire contact element; and a removable linking module coupled to the housing, the linking module including movable contact means for electrically linking said service wire terminating means and said exchange wire terminating means, wherein said contact means is movable between a first position which forms an electrically conductive path between the service wire terminating means and the exchange wire terminating means and a second position which breaks the conductive path such that the service signal and the exchange signal may be independently tested.

2. A terminal block as in claim 1, wherein said contact means in said first position further provides a test lead opening for providing signal test access to the conductive path formed between the service wire terminating means and the exchange wire terminating means.

3. A terminal block as in claim 1, wherein said linking module comprises:

a service wire test element and an exchange wire test element; and a module cover having a first, open position and a second, closed position;

wherein said contact means comprises a junction contact secured to an interior of said module cover, wherein when said cover is closed said junction contact provides an electronically conductive bridge between said service wire test element and said exchange wire test element, and wherein when said cover is open the conductive bridge is disconnected between the service wire and the exchange wire and a test lead may be connected to said service wire test element in order to test the service signal and a test lead may be connected to said exchange wire test element in order to test the exchange signal.

4. A terminal block as in claim 3, wherein said linking module further includes;

a gas discharge tube having a first end electrically connected to one of said service wire test element and said exchange side test element and a second end electrically connected to an earth junction contact for providing a connection to earth; and means for creating a conductive connection between said earth junction contact and earth such that when said gas discharge tube registers excessive voltage on said electrically conductive bridge, the excessive voltage is shunted through said gas discharge tube to earth.

5. A terminal block as in claim 1, wherein said electrically conductive bridge formed within said linking module is enveloped by a flowable electrically insulating medium.

6. A modular terminal block for connecting a service wire to an exchange wire comprising:

a mounting member;

a housing;

service wire terminating means configured within said housing, said service wire terminating means including a service wire contact element;

mounting means for releasably mounting the housing to the mounting member;

means for terminating an exchange wire in response to activation of said mounting means, said exchange wire terminating means including an exchange wire contact element; and linking means comprising an electrically conductive path between said service wire contact element and said exchange wire contact element.

7. A terminal block as in claim 6, wherein said linking means includes a module having a test lead opening for providing access to the electrically conductive path formed between the service wire and the exchange wire.

8. A terminal block as in claim 6, wherein said housing includes an access lack and wherein said linking means is removably coupled to said access lack and includes a module including a set of integrally formed contacts which include a service wire junction contact and an exchange wire junction contact such that when said module is plugged into said access jack a conductive path is formed between the service wire and the exchange wire through said set of integrally formed contacts.

9. A terminal block s in claim 8, wherein said mounting member includes a mounting rail is electrically connected to earth and said linking means further includes:

a gas discharge tube having a first end electrically connected to said set of integrally formed contacts, and a second end electrically connected to an earth junction contact for providing a connection to earth; and means for creating a conductive connection between said earth junction contact and said mounting rail electrically connected to earth such that when excessive voltage appears on said set of integrally formed contacts the excessive voltage is shunted by said gas discharge tube to earth.

10. A terminal block as in claim 6, wherein said exchange wire terminating means comprises:

an exchange wire carrier having an exchange wire conduit therethrough; and a slot in said wire carrier extending across said conduit, wherein said exchange wire contact element is a metal element with a portion extending into said exchange wire carrier having a slotted insulation cutting blade extending toward said slot in said conduit.

11. A terminal block as in claim 10, wherein said exchange wire terminating means is actuated into the closed position when the terminal block is installed onto the mounting member.

12. A terminal block as in claim 6, wherein said mounting means comprises:

a front lip proximate said service wire terminating means which secures a front side of the housing to said mounting member; and a rear clip located proximate said exchange wire terminating means which secures a rear side of the housing to said mounting member, wherein said exchange wire terminating means is actuated into the closed position when the rear side of the housing is installed onto said mounting member.

13. A terminal block as in claim 12, wherein said mounting means further comprises:

an earth connector guide integrally formed with said exchange wire carrier;

an earth connector disposed within said earth connecter guide and integrally formed with an earth ground junction contact; and a mounting rail electrically connected to earth and having a slot to receive said earth connector guide, wherein said earth connector is guided by, said earth connector guide into said mounting rail slot and connected to earth when the rear side of the housing is installed onto said mounting rail.

14. A terminal block as in claim 6, wherein said housing includes a first chamber having said means for terminating a service wire therein, wherein said housing includes a second chamber including said means for terminating an exchange wire therein and wherein said means for linking includes a third chamber, wherein said first, second and third chambers are filled with a flowable electrically insulating medium.

* * * * *